US011142929B2

(12) United States Patent
Griswold et al.

(10) Patent No.: US 11,142,929 B2
(45) Date of Patent: Oct. 12, 2021

(54) EXIT DEVICE

(71) Applicant: Sargent Manufacturing Company, New Haven, CT (US)

(72) Inventors: Lee Griswold, Bethel, CT (US); Sean Svendsen, Sunbury, OH (US); Eric Fickas, Plain City, OH (US)

(73) Assignee: Sargent Manufacturing Company, New Haven, CT (US)

( * ) Notice: Subject to any disclaimer, the term of this patent is extended or adjusted under 35 U.S.C. 154(b) by 262 days.

(21) Appl. No.: 16/376,477

(22) Filed: Apr. 5, 2019

(65) Prior Publication Data

US 2019/0309543 A1 Oct. 10, 2019

Related U.S. Application Data

(60) Provisional application No. 62/655,088, filed on Apr. 9, 2018.

(51) Int. Cl.

| | |
|---|---|
| ***E05B 65/10*** | (2006.01) |
| ***E05B 41/00*** | (2006.01) |
| ***E05B 13/00*** | (2006.01) |

(52) U.S. Cl.

CPC ..... *E05B 65/1093* (2013.01); *E05B 13/007* (2013.01); *E05B 41/00* (2013.01); *E05B 65/1046* (2013.01)

(58) Field of Classification Search

CPC .... E05B 1/0038; E05B 13/002; E05B 13/007; E05B 13/105; E05B 41/00; E05B 65/10; E05B 65/1046; E05B 65/1053; E05B 65/106; E05B 65/1066; E05B 65/1073; E05B 65/1093

See application file for complete search history.

(56) References Cited

U.S. PATENT DOCUMENTS

| | | | | |
|---|---|---|---|---|
| D114,825 | S | 5/1939 | Schmidt et al. | |
| 3,663,047 | A | 5/1972 | Zawadzki | |
| 3,877,262 | A * | 4/1975 | Williams | E05B 65/1073 70/92 |
| 4,167,280 | A | 9/1979 | Godec et al. | |
| D261,099 | S | 10/1981 | Russell et al. | |
| D268,003 | S | 2/1983 | Ohno | |
| D276,306 | S | 11/1984 | Turner et al. | |
| 4,624,490 | A | 11/1986 | Miller | |
| D295,254 | S | 4/1988 | Matsuo et al. | |
| D297,806 | S | 9/1988 | Mohn | |
| 4,796,931 | A | 1/1989 | Heid | |

(Continued)

FOREIGN PATENT DOCUMENTS

EP 2 998 490 A1 3/2016

OTHER PUBLICATIONS

International Preliminary Report on Patentability for International Application No. PCT/US2019/026257, dated Oct. 22, 2020.

(Continued)

*Primary Examiner* — Christopher J Boswell
(74) *Attorney, Agent, or Firm* — Wolf, Greenfield & Sacks, P.C.

(57) ABSTRACT

Embodiments described herein relate to an exit device having a construction that facilitates visual inspection of the state of the exit device. Embodiments of the exit device include a visual indicator as to the state (dogged or undogged) of the exit device.

9 Claims, 7 Drawing Sheets

(56) References Cited

U.S. PATENT DOCUMENTS 4,801,163 A * 1/1989 Miller ..... E05B 65/1073 70/92
4,875,722 A * 10/1989 Miller ..... E05B 65/1073 70/92
4,961,330 A 10/1990 Evans
5,016,927 A 5/1991 Toledo
D318,410 S 7/1991 Mohn
5,042,851 A 8/1991 Hunt
D331,182 S 11/1992 Hsien
5,219,385 A * 6/1993 Yeh ..... E05B 65/1046 70/92
5,412,961 A 5/1995 Cain et al.
5,581,230 A 12/1996 Barrett
5,590,917 A 1/1997 Brooks et al.
D416,779 S 11/1999 Trumpinski et al.
6,009,732 A 1/2000 Haeck et al.
D421,561 S 3/2000 Fenwick et al.
6,032,985 A 3/2000 Cutter
D422,195 S 4/2000 Tonozzi et al.
D424,404 S 5/2000 Jensen et al.
D428,793 S 8/2000 Bruno
D438,088 S 2/2001 Tomlinson
D439,131 S 3/2001 Bruno
6,205,825 B1 3/2001 Haeck et al.
6,532,777 B2 3/2003 Haeck et al.
D484,389 S 12/2003 Evans
6,715,225 B1 4/2004 Frolov et al.
6,769,723 B2 * 8/2004 Cohrs, Jr. ..... E05B 65/1053 292/92
6,779,819 B2 8/2004 Surko, Jr.
6,820,905 B1 11/2004 Haeck et al.
6,854,773 B2 * 2/2005 Lin ..... E05B 65/104 292/92
D507,472 S 7/2005 Arnold
D526,557 S 8/2006 Falconer et al.
7,204,050 B2 4/2007 Molokotos et al.
D541,633 S 5/2007 Austin et al.
D542,626 S 5/2007 Toloday et al.
D578,860 S 10/2008 James et al.
7,469,942 B2 12/2008 Whitaker et al.
7,484,777 B2 2/2009 Condo et al.
7,528,700 B2 5/2009 Picard et al.
7,536,885 B1 5/2009 Ross et al.
D604,585 S 11/2009 Veltz et al.
D623,499 S 9/2010 Tien
7,832,777 B2 11/2010 Banks et al.
7,832,778 B2 11/2010 Whitaker et al.
7,905,522 B1 3/2011 Picard
D647,781 S 11/2011 Tejszerski et al.
8,070,192 B2 12/2011 Tien
D656,386 S 3/2012 Shen
8,146,961 B2 4/2012 Schacht
8,156,671 B2 4/2012 Presley et al.
8,201,857 B2 6/2012 Tien
8,267,441 B2 9/2012 Lin
D669,333 S 10/2012 Tien
D669,334 S 10/2012 Tien
D669,335 S 10/2012 Tien
D669,336 S 10/2012 Tien
D669,337 S 10/2012 Tien
D669,338 S 10/2012 Tien
8,495,836 B2 7/2013 Lowder et al.
8,978,305 B2 3/2015 Morstatt et al.
9,021,745 B2 * 5/2015 Harris ..... E05B 65/1053 49/506
D739,707 S 9/2015 Noel
D760,059 S 6/2016 Nishida Watson
9,376,835 B2 6/2016 Schildwachter et al.
9,428,924 B2 8/2016 Harris et al.
D772,051 S 11/2016 Martin
D790,950 S 7/2017 Kraus et al.
D803,027 S 11/2017 Huang et al.
9,816,291 B2 * 11/2017 Wong ..... E05B 65/1053
9,878,305 B2 1/2018 Hossain et al.
9,945,158 B2 * 4/2018 Lehner, Jr. ..... E05B 65/1046
10,060,161 B2 * 8/2018 Shen ..... E05B 65/1046
D867,103 S 11/2019 Griswold et al.
D867,851 S 11/2019 Griswold et al.
10,597,910 B2 3/2020 Chen et al.
D891,220 S 7/2020 Griswold et al.
D891,221 S 7/2020 Griswold et al.
10,745,942 B2 8/2020 Lehner, Jr. et al.
D906,084 S 12/2020 Griswold
D906,085 S 12/2020 Griswold
2005/0104381 A1 5/2005 Whitaker et al.
2005/0144822 A1 7/2005 Molokotos et al.
2006/0267356 A1 11/2006 Catalano
2011/0012372 A1 1/2011 Presley et al.

OTHER PUBLICATIONS

PCT/US2019/026257, Oct. 22, 2020, International Preliminary Report on Patentability.
PCT/US2019/026257, Jul. 2, 2019, International Search Report and Written Opinion.
International Search Report and Written Opinion for International Application No. PCT/US2019/026257, dated Jul. 2, 2019.
[No Author Listed] Classroom Security Systems. Sargent Assa Abloy. https://content.assaabloyusa.com/doc/AADSS1065368. Publicly available at least as early as Jan. 2019; last accessed Jul. 19, 2019, 6 pages.
[No Author Listed] Exit Device—Sargent Assa Abloy DSS—Facility Management Product Release. FacilitiesNet. https://www.facilitiesnet.com/buildingproducts/details/Exit-Device-Sargent-Assa-Abloy-Dss-Sargent-Assa-Abloy-Dss--8148. Posted Aug. 3, 2015, 2 pages.
[No Author Listed] SARGENT Classroom Security Exit Device with Lock/Unlock Indicator YouTube.com. https://www.youtube.com/watch?v=gCxMnz2noNU. Aug. 25, 2014, 1 page.

* cited by examiner

EXIT DEVICE

RELATED APPLICATIONS

This application claims the benefit under 35 U.S.C. § 119(e) to U.S. Provisional Application No. 62/655,088, filed Apr. 9, 2018, which is incorporated herein in its entirety.

FIELD

Disclosed embodiments are related to an exit device for a door.

BACKGROUND

Exit devices having push bars are commonly installed on high traffic commercial doors for use as a primary opening mechanism. Such exit devices generally include a depressible push bar that translates the pushing of the bar by a user to the retracting of the door latch. Some doors equipped with push bars have standard knobs or handles on the opposite side of the door for operating the latch. Further, the exit device can be placed in a "dogged" state, in which the push bar is held in a depressed position, allowing the latch to remain in an open or retracted position and the door to be pushed open without depressing the bar.

SUMMARY

In one aspect, an exit device is disclosed. The exit device is constructed and arranged to facilitate visual inspection of the state of the exit device, wherein the state of the device is one of a dogged state and an undogged state.

In another aspect, an exit device is disclosed. The exit device includes a housing; a push bar operatively coupled to the housing and moveable between an extended position and a depressed position, the push bar having a proximal surface; and a latch operatively coupled to the push bar such that actuation of the push bar from the extended position to the depressed position causes the latch to move from the latched or extended position to an unlatched or retracted position. The exit device also includes a latch region housing that houses the latch, the latch region housing has a proximal surface. An end region housing is located at an end opposite the latch region housing, the end region housing having a proximal surface. A push bar region housing is located between the end region housing and the latch region housing. When the exit device is in an undogged state where the push bar is in the extended position, the proximal surface of the push bar effectively aligns with the proximal surface of the end region housing and, when the exit device is in the dogged state where the push bar is in the depressed position, the proximal surface of the push bar effectively aligns with the proximal surface of the latch region housing.

In yet another aspect, an exit device for a door is disclosed. The exit device includes a housing; a push bar operatively coupled to the housing and moveable between an extended position and a depressed position; an end region housing; and a push bar region housing located adjacent the end region housing. A mid-transition region is located between the end region housing and the push bar region housing. The mid-transition region includes a surface. When the exit device is in the undogged state, the surface of the mid-transition region is visually effectively concealed and when the exit device is in the dogged state, the mid-transition region surface is visually exposed, with the mid-transition region surface being colored with a color contrasting with adjacent portion of the exit device.

In yet another aspect, an exit device for a door is disclosed. The exit device includes a housing; a push bar operatively coupled to the housing and moveable between an extended position and a depressed position; a latch region housing; and a push bar region housing located adjacent the latch region housing. A latch transition region is located between the latch region housing and the push bar region housing. The latch transition region includes a surface. When the exit device is in the undogged state, the surface of the latch transition region is visually effectively concealed and when the exit device is in the dogged state, the latch transition region surface is visually exposed, with the latch transition region surface being colored with a color contrasting with adjacent portions of the exit device.

It should be appreciated that the foregoing concepts, and additional concepts discussed below, may be arranged in any suitable combination, as the present disclosure is not limited in this respect. Further, other advantages and novel features of the present disclosure will become apparent from the following detailed description of various non-limiting embodiments when considered in conjunction with the accompanying figures.

BRIEF DESCRIPTION OF DRAWINGS

The accompanying drawings are not intended to be drawn to scale. In the drawings, each identical or nearly identical component that is illustrated in various figures may be represented by a like numeral. For purposes of clarity, not every component may be labeled in every drawing. In the drawings.

DETAILED DESCRIPTION

Figure 1:
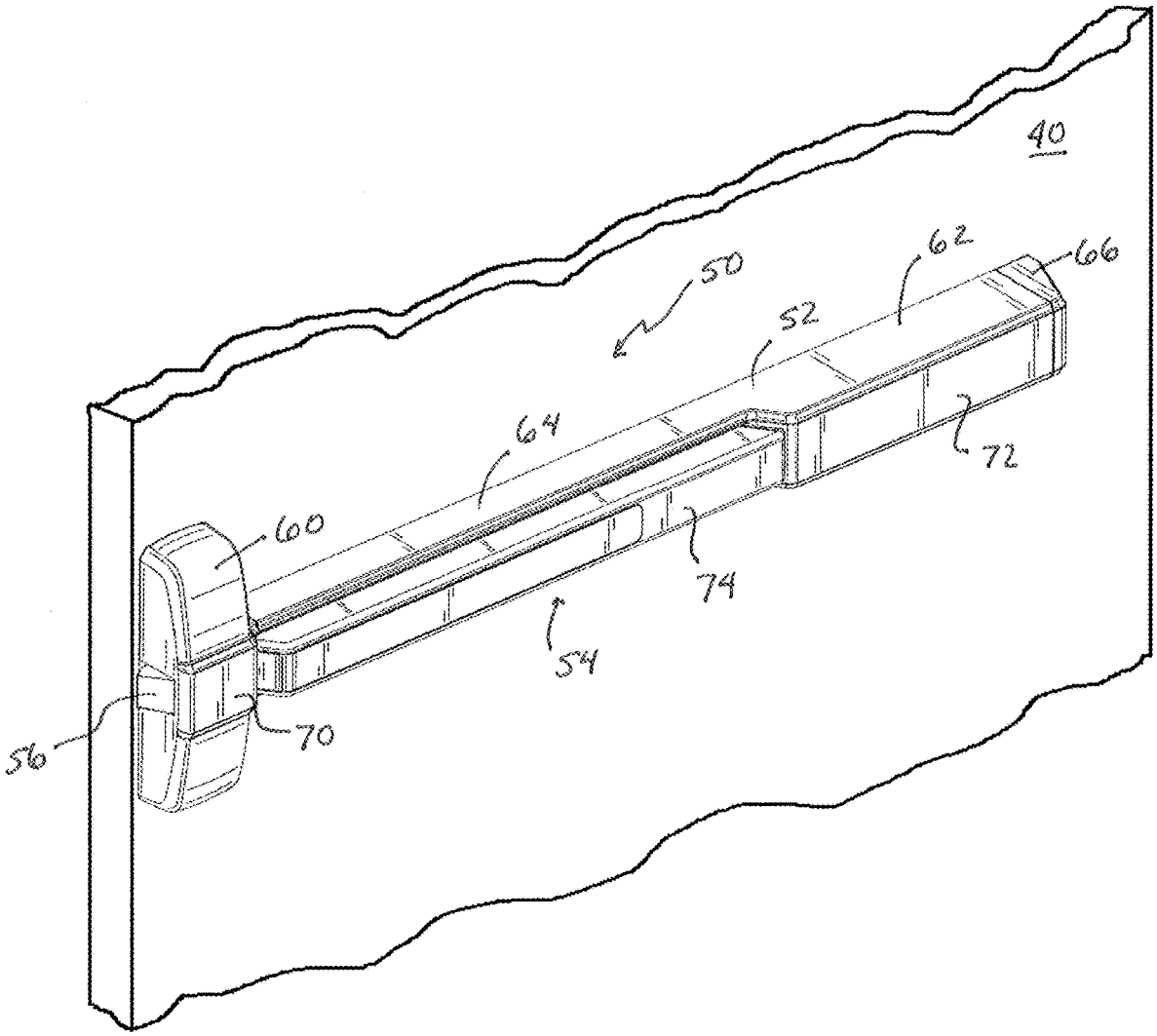
FIG. 1 is a front left top perspective view of a push bar exit device according to one embodiment shown mounted to a door.

Push bar equipped doors are commonly found throughout commercial and industrial buildings. In many buildings, the push bars throughout the facility are placed in a depressed position such that the exit device is placed in a dogged state during business hours or particularly high traffic times in order to reduce potential congestion at entries and exit points. In this respected, when the exit device is in the dogged state, the push bar is maintained in the depressed position such that the latch of the exit device is held in a retracted position allowing the door to be freely pushed open without the need for actuating the exit device. Many conventional push bar exit devices rely on simple mechanical mechanisms such as a key or a knob controlled catch to hold the bar in the depressed position and thereby place the exit device in the dogged state. Many facilities will have security officers or building managers make rounds at the end of each day, stopping at each door to ensure that the exit devices are placed in the undogged state to secure the building entry locations. The inventors have contemplated that an exit device having a construction that facilitates visual inspection of the state of the exit device could be implemented. Thus, the exit device includes a visual indicator as to the state (dogged or undogged) of the exit device.

According to one embodiment, the exit device includes a housing (also referred to as a rail), a push bar operatively coupled to the rail and moveable between a retracted position and a depressed position, and a latch operatively coupled to the push bar such that actuation of the push bar from the extended position to the depressed position causes the latch to move from the latched or extended position to an unlatched or retracted position. The housing of the exit device includes a latch region housing that houses the latch, an end region housing located at an end opposite the latch region housing, and a push bar region housing located between the end region housing and the latch region housing. The end region housing and the latch region housing each have a proximal surface. As will be used herein, the "proximal" surface refers to the outer-most surface closest to a user when the exit device is mounted to a door.

According to one embodiment, the push bar also has a proximal surface that, when the exit device is in an undogged state where the push bar is in the extended position, the proximal surface of the push bar effectively aligns with the proximal surface of the end region housing. That is, the two surface lie in substantially the same plane. When the exit device is in the dogged state where the push bar is in the depressed position, the proximal surface of the push bar effectively aligns with the proximal surface of the latch region housing. Without being bound by theory, the alignment of the push bar proximal surface with the end region housing proximal surface provides a visual indication to a building inspector or other security personnel or user that the exit device is in an undogged state whereas the alignment of the push bar proximal surface with the latch region housing proximal surface provides a visual indication that the exit device is in a dogged state.

According to another embodiment, the housing includes a mid-transition region located between the end region housing and the push bar region housing. The mid-transition region also includes a surface. When the exit device is in the undogged state, the surface of the mid-transition region is visually substantially concealed. When the exit device is in the dogged state, the mid-transition region surface is visually exposed. Without being bound by theory, exposing the mid-transition region surface provides a visual indication of the dogged state of the exit device. In one embodiment, the mid-transition region surface may include further visual cues as to the state of the exit device. For example, the mid-transition region surface may be colored with a color that contrasts with the color of adjacent portions of the exit device or may include active components such as one or more light sources. In one embodiment, the exit device may be colored silver or grey (such as being formed of stainless steel) and the mid-transition region surface may be colored black, red, orange, blue, green, yellow or any other color or combinations thereof. Alternatively, all or portions of the exit device may be colored black and the mid-transition region may be left in its natural state of the base material, such as stainless steel colored or may be colored a contrasting color such as red, orange, blue, green, yellow or any other color or combinations thereof. The mid-transition region surface may also or instead include a highly reflective surface which may reflect light from a flashlight or environmental light incident on the mid-transition region surface. Further, the mid-transition region may be provided with a light source, such as LED lighting, that illuminates when the exit device is in the dogged state. Other surface treatments of the mid-transition region surface may also be employed, such as visually perceptible textures.

According to another embodiment, the housing includes a latch transition region located between the latch region housing and the push bar region housing. The latch transition region also includes a surface. When the exit device is in the undogged state, the surface of the latch transition region is visually substantially concealed. When the exit device is in the dogged state, the latch transition region surface is visually exposed. Without being bound by theory, exposing the latch transition region surface provides a visual indication of the dogged state of the exit device. In one embodiment, the latch transition region surface may also include further visual cues as to the state of the exit device. For example, the latch transition region surface may be colored with a color that contrasts with the color of adjacent portions of the exit device. In one embodiment, the exit device may be colored silver or grey (such as being formed of stainless steel) and the latch transition region surface may be colored black, red, orange, blue, green, yellow or any other color or combinations thereof. Alternatively, all or portions of the exit device may be colored black and the latch transition region surface may be left in its natural state of the base material, such as stainless steel colored or may be colored a contrasting color such as red, orange, blue, green, yellow or any other color or combinations thereof. The latch transition region surface may also or instead include a highly reflective surface which may reflect light from a flashlight or environmental light incident on the latch transition region surface. Further, the latch transition region may be provide with a light source, such as LED lighting, that illuminates when the exit device is in the dogged state. Other surface treatments of the latch transition region surface may also be employed, such as visually perceptible textures.

In one embodiment, the exit device includes an access hole that allows personnel to place the exit device in the dogged or undogged state. The access hole receives a key or other tool to allow access to the mechanism that holds the exit device in the dogged state. In one embodiment, the access hole is located in either the mid-transition region or in the latch transition region. In this respect, when the push bar is in the depressed position, such as when the exit device is in the dogged state, the access hole is exposed.

Turning to the figures, specific non-limiting embodiments are described in further detail. It should be understood that the various components and features and described relative to these embodiments may be used either individually and/or in any desired combination as the disclosure is not limited to only the specific embodiments described herein.

FIG. 1 depicts an exit device 50 that includes a housing 52 (also referred to as a rail) and a push bar 54 operatively coupled to the rail. A user can depress the push bar 54 to cause the exit device latch 56 to retract, allowing the door 40 to be swung open. As is known in the art, such exit devices can be placed in a dogged state. In the dogged state, the push bar 54 is held in a depressed position, keeping the exit device latch retracted. The housing 52 includes a latch region housing 60 that houses the latch 56, an end region housing 62 located an end opposite the latch region housing 60, and a push bar region housing 64 located between the end region housing 62 and the latch region housing 64. The latch region housing 60 and the end region housing 62 each have a proximal surface 70, 72 respectively. The push bar 54 also includes a proximal surface 74.

The end region housing 72 can be trimmed shorter during installation of the bar to ensure that the exit device 50 matches the size of the door 40. An end cap 66 may be positioned at the end of the housing 52 once the housing 52 is trimmed to size.

Figure 2:
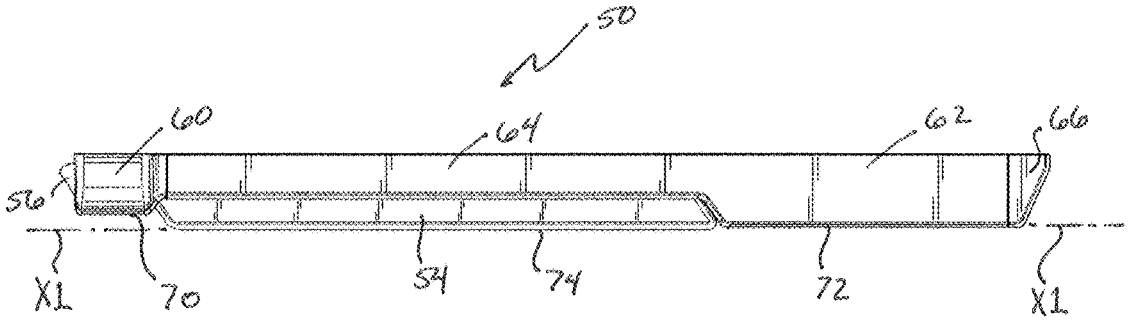
FIG. 2 is a top plan view of the exit device of FIG. 1 with the push bar shown in the extended position.
Figure 3:
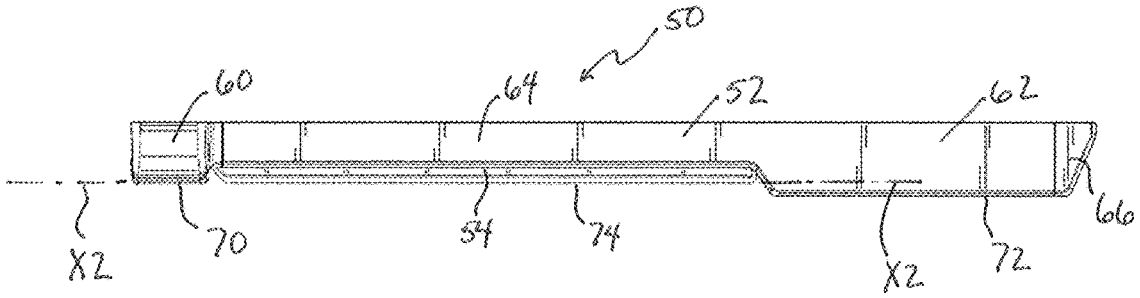
FIG. 3 is a top plan of the exit device of FIG. 1 with the push bar shown in the depressed position.

FIG. 2 is a top plan view of the exit device 50. According to one embodiment, when the exit device 50 is in an undogged state where the push bar is in the extended position, as shown in FIG. 2, the proximal surface 74 of the push bar effectively aligns with the proximal surface 72 of the end region housing 62. That is, the two surface lie in substantially the same plane X1. As shown in FIG. 3, which is a top plan view of the exit device 50 in the dogged state, the push bar 54 is in the depressed position. As shown, the proximal surface 74 of the push bar 54 effectively aligns with the proximal surface 70 of the latch region housing 60. That is, the two surface lie in substantially the same plane X2. Without being bound by theory, the alignment of the push bar proximal surface 74 with the end region housing proximal surface 72 (FIG. 2) provides a visual indication to a building inspector or other security personnel or user that the exit device 50 is in an undogged state whereas the alignment of the push bar proximal surface 74 with the latch region housing proximal surface 70 (FIG. 3) provides a visual indication that the exit device 50 is in a dogged state.

Figure 4:
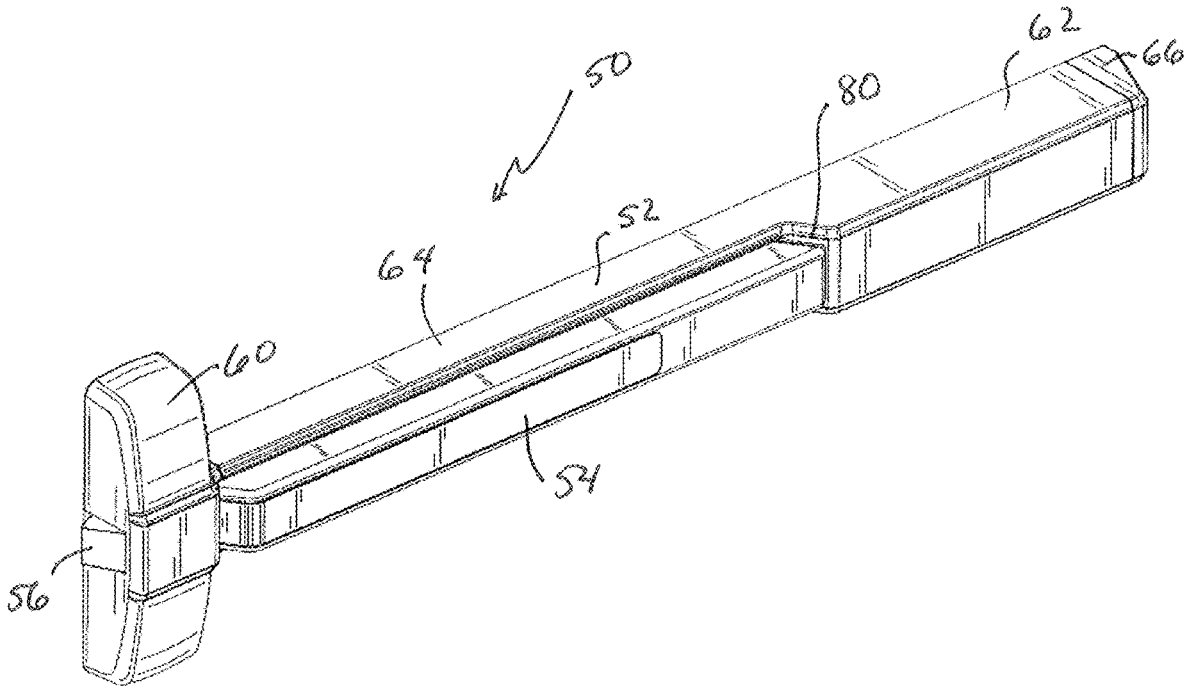
FIG. 4 is a front left top perspective view of the exit device according to another embodiment, with the push bar shown in the extended position.
Figure 5:
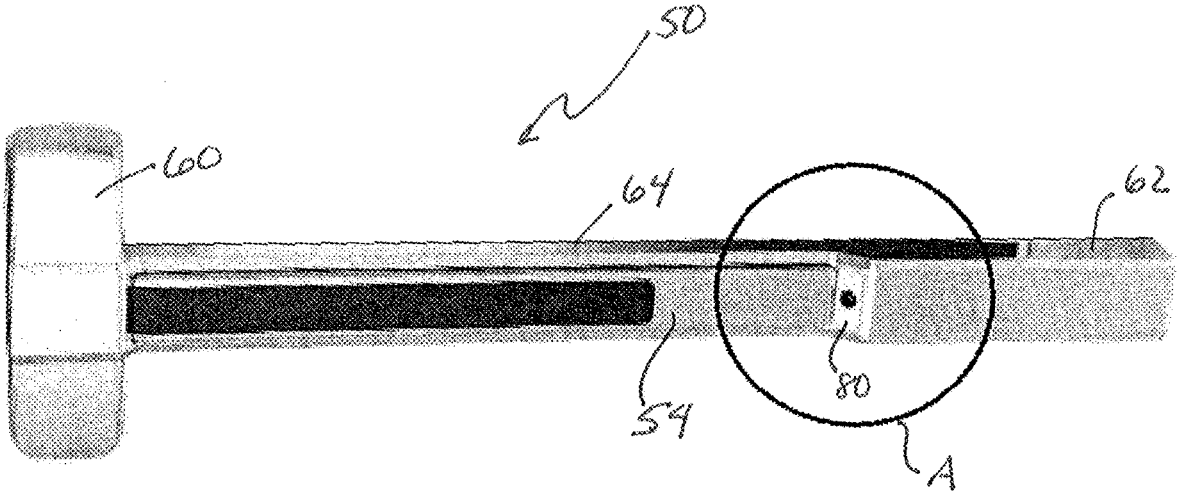
FIG. 5 is a front left top perspective view of the exit device of FIG. 4, with the push bar shown in the depressed position.
Figure 6:
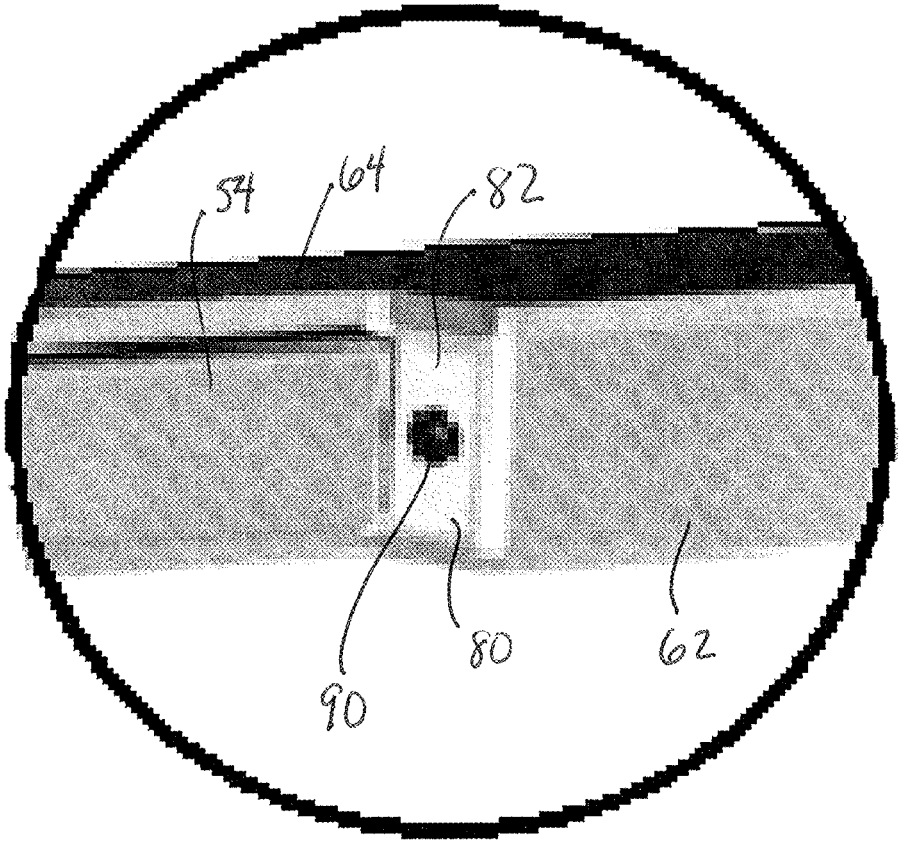
FIG. 6 is an enlarged view of the area encircled by "A" of FIG. 5.

Referring to FIGS. 4-6, in one embodiment, the housing includes a mid-transition region 80 located between the end region housing 62 and the push bar region housing 64. The mid-transition region 80 includes a surface 82 (see FIG. 6). When the exit device 50 is in the undogged state, the surface 82 of the mid-transition region is visually substantially concealed. When the exit device 50 is in the dogged state, the mid-transition region surface 82 is visually exposed. Without being bound by theory, exposing the mid-transition region surface 82 provides a visual indication of the dogged state of the exit device 50. In one embodiment, the mid-transition region surface 82 may include further visual cues as to the state of the exit device 50. For example, the mid-transition region surface 82 may be colored with a color that contrasts with the color of adjacent portions of the exit device 50. In one embodiment, the exit device 50 may be colored silver or grey (such as being formed of stainless steel) and the mid-transition region surface 82 may be colored black, red, orange, blue, green, yellow or any other color or combinations thereof. Alternatively, all or portions of the exit device 50 may be colored black and the mid-transition region surface 82 may be left in its natural state of the base material, such as stainless steel colored or may be colored a contrasting color such as red, orange, blue, green, yellow or any other color or combinations thereof. The mid-transition region surface 82 may also or instead include a highly reflective surface which may reflect light from a flashlight or environmental light incident on the mid-transition region surface. Further, the mid-transition region 80 may be provided with a light source (not shown), such as LED lighting, that illuminates when the exit device 50 is in the dogged state. Other surface treatments for the mid-transition region surface 82 may also be employed, such as visually perceptible textures.

Figure 7:
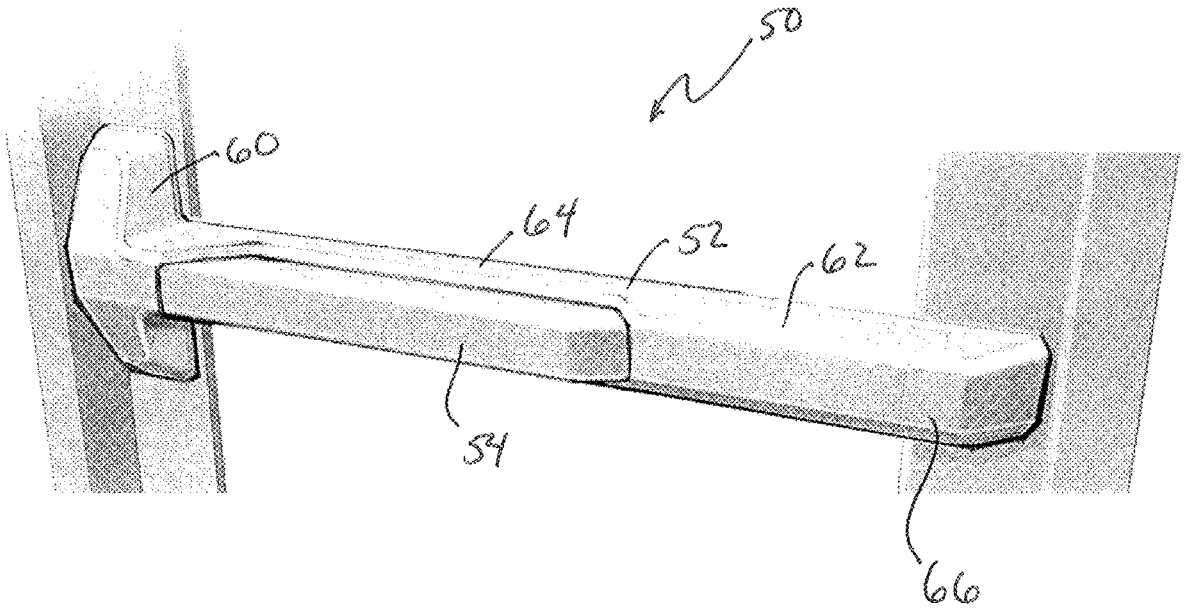
FIG. 7 is a front right top perspective view of the exit device according to another embodiment, with the push bar shown in the extended position.
Figure 8:
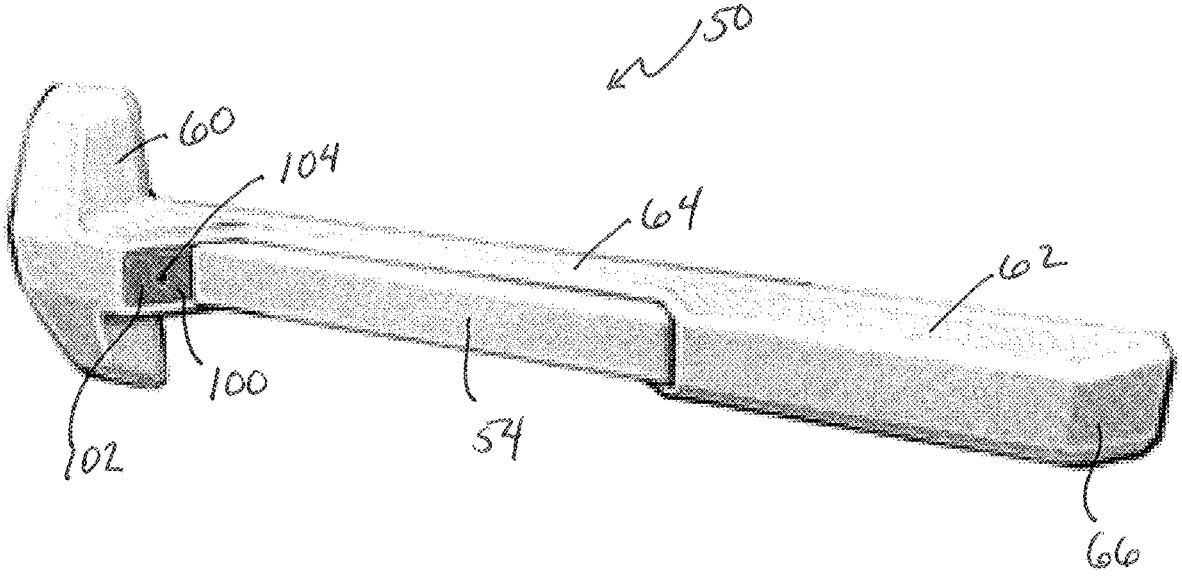
FIG. 8 is a front right top perspective view of the exit device, with the push bar shown in the depressed position.

Referring to FIGS. 7 and 8, in one embodiment, the housing 52 includes a latch transition region 100 (see FIG. 7) located between the latch region housing 60 and the push bar region housing 64. The latch transition region 100 also includes a surface 102. When the exit device 50 is in the undogged state (FIG. 7), the surface 102 of the latch transition region 100 is visually substantially concealed. When the exit device 50 is in the dogged state, the latch transition region surface 102 is visually exposed. As noted above with respect to the mid-transition region 80, without being bound by theory, exposing the latch transition region surface 102 provides a visual indication of the dogged state of the exit device 50. In one embodiment, the latch transition region surface 102 may also include further visual cues as to the state of the exit device 50. For example, the latch transition region surface 102 may be colored with a color that contrasts with the color of adjacent portions of the exit device 50. In one embodiment, the exit device 50 may be colored silver or grey (such as being formed of stainless steel) and the latch transition region surface 102 may be colored black, red, orange, blue, green, yellow or any other color or combinations thereof. Alternatively, all or portions of the exit device 50 may be colored black and the latch transition region surface 102 may be left in its natural state of the base material, such as stainless steel colored or may be colored a contrasting color such as red, orange, blue, green, yellow or any other color or combinations thereof. The latch transition region surface 102 may also or instead include a highly reflective surface which may reflect light from a flashlight or environmental light incident on the latch transition region surface. Further, the latch transition region 100 may be provided with a light source (not shown), such as LED lighting, that illuminates when the exit device is in the dogged state. Other surface treatments for the latch transition region surface 102 may also be employed, such as visually perceptible textures.

As discussed above, in one embodiment, the exit device 50 includes an access hole that allows personnel to place the exit device in the dogged or undogged state. The access hole receives a key or other tool to allow access to the mechanism that holds the exit device in the dogged state. In the embodiment described with reference to FIGS. 4-6, an access hole 90 is located in the mid-transition region 80. In the embodiment described with reference to FIGS. 7-8, an access hole 104 is located in the latch transition region 100. In this respect, when the push bar is in the depressed position, such as when the exit device is in the dogged state, the access hole is exposed.

It should be appreciated that although FIGS. 1-6 depict a style of an exit device different from the style of the exit device of FIGS. 7 and 8, the aspects described herein may be employed in any suitable combination in an exit device.

The exit device 50 may be formed of any suitable material using any suitable manufacturing techniques. In one embodiment, the exit device is formed of steel, such as stainless steel and may be formed by stamping sheet metal into suitably shaped components. Other materials may be applied to the housing such as rubber or plastic strips attached to user operable or other surfaces. The rubber or plastic material may be colored black and may be snap fit, screwed, glued or molded onto the mating surfaces. Other suitable constructs may be employed, as the present disclosure is not limited in this respect.

Various aspects of the present disclosure may be used alone, in combination, or in a variety of arrangements not specifically discussed in the embodiments described in the foregoing and is therefore not limited in its application to the details and arrangement of components set forth in the foregoing description or illustrated in the drawings. For example, aspects described in one embodiment may be combined in any manner with aspects described in other embodiments. While the present teachings have been described in conjunction with various embodiments and examples, it is not intended that the present teachings be limited to such embodiments or examples. On the contrary, the present teachings encompass various alternatives, modifications, and equivalents, as will be appreciated by those of skill in the art. Accordingly, the foregoing description and drawings are by way of example only.

What is claimed is:

1. An exit device comprising:

a housing;

a push bar operatively coupled to the housing and moveable between an extended position and a depressed position, the push bar having a proximal surface;

a latch operatively coupled to the push bar such that actuation of the push bar from the extended position to the depressed position causes the latch to move from the latched or extended position to an unlatched or retracted position;

a latch region housing that houses the latch, the latch region housing having a proximal surface;

an end region housing located at an end opposite the latch region housing, the end region housing having a proximal surface; and, a push bar region housing located between the end region housing and the latch region housing, wherein, when the exit device is in an undogged state where the push bar is in the extended position, the proximal surface of the push bar effectively aligns with the proximal surface of the end region housing and wherein, when the exit device is in a dogged state where the push bar is in the depressed position, the proximal surface of the push bar effectively aligns with the proximal surface of the latch region housing.

2. The exit device of claim 1, wherein the housing includes a mid-transition region located between the end region housing and the push bar region housing, the mid-transition region including a surface wherein, when the exit device is in the undogged state, the surface of the mid-transition region is visually substantially concealed and when the exit device is in the dogged state, the mid-transition region surface is visually exposed.

3. The exit device of claim 2, wherein the mid-transition region surface is colored with a color that contrasts with adjacent portions of the exit device.

4. The exit device of claim 2, further comprising an access hole constructed and arranged to allow the exit device to be placed in one of the dogged and undogged states, wherein the access hole is located in the mid-transition region.

5. An exit device comprising:

a housing;

a push bar operatively coupled to the housing and moveable between an extended position and a depressed position, the push bar having a proximal surface;

a latch operatively coupled to the push bar such that actuation of the push bar from the extended position to the depressed position causes the latch to move from the latched or extended position to an unlatched or retracted position;

a latch region housing that houses the latch, the latch region housing having a proximal surface;

an end region housing located at an end opposite the latch region housing, the end region housing having a proximal surface; and, a push bar region housing located between the end region housing and the latch region housing, wherein, when the exit device is in an undogged state where the push bar is in the extended position, the proximal surface of the push bar effectively aligns with the proximal surface of the end region housing and wherein, when the exit device is in a dogged state where the push bar is in the depressed position, the proximal surface of the push bar effectively aligns with the proximal surface of the latch region housing, wherein the housing includes a mid-transition region located between the end region housing and the push bar region housing, the mid-transition region including a surface wherein, when the exit device is in the undogged state, the surface of the mid-transition region is visually substantially concealed and when the exit device is in the dogged state, the mid-transition region surface is visually exposed, and wherein at least some portions of the exit device are colored black and the mid-transition region surface is uncolored.

6. An exit device comprising:

a housing;

a push bar operatively coupled to the housing and moveable between an extended position and a depressed position, the push bar having a proximal surface;

a latch operatively coupled to the push bar such that actuation of the push bar from the extended position to the depressed position causes the latch to move from the latched or extended position to an unlatched or retracted position;

a latch region housing that houses the latch, the latch region housing having a proximal surface;

an end region housing located at an end opposite the latch region housing, the end region housing having a proximal surface; and, a push bar region housing located between the end region housing and the latch region housing, wherein, when the exit device is in an undogged state where the push bar is in the extended position, the proximal surface of the push bar effectively aligns with the proximal surface of the end region housing and wherein, when the exit device is in a dogged state where the push bar is in the depressed position, the proximal surface of the push bar effectively aligns with the proximal surface of the latch region housing, wherein the housing includes a mid-transition region located between the end region housing and the push bar region housing, the mid-transition region including a surface wherein, when the exit device is in the undogged state, the surface of the mid-transition region is visually substantially concealed and when the exit device is in the dogged state, the mid-transition region surface is visually exposed, and wherein the mid-transition region surface includes a reflective surface.

7. An exit device comprising:

a housing;

a push bar operatively coupled to the housing and moveable between an extended position and a depressed position;

an end region housing;

a push bar region housing located adjacent the end region housing; and, a mid-transition region located between the end region housing and the push bar region housing, the mid-transition region including a surface, wherein when the exit device is in an undogged state, the surface of the mid-transition region is visually effectively concealed and wherein when the exit device is in a dogged state, the mid-transition region surface is visually exposed, with the mid-transition region surface being colored with a color contrasting with adjacent portion of the exit device.

8. The exit device of claim 7, further comprising an access hole constructed and arranged to allow the exit device to be placed in one of the dogged and undogged states, wherein the access hole is located in the mid-transition region.

9. An exit device comprising:

a housing;

a push bar operatively coupled to the housing and moveable between an extended position and a depressed position;

an end region housing;

a push bar region housing located adjacent the end region housing; and, a mid-transition region located between the end region housing and the push bar region housing, the mid-transition region including a surface, wherein when the exit device is in an undogged state, the surface of the mid-transition region is visually effectively concealed and wherein when the exit device is in a dogged state, the mid-transition region surface is visually exposed, with the mid-transition region surface being colored with a color contrasting with adjacent portion of the exit device, and wherein the mid-transition region surface includes a reflective surface.

* * * * *